US005109181A

United States Patent [19]

Fischer et al.

[11] Patent Number: 5,109,181

[45] Date of Patent: Apr. 28, 1992

[54] HIGH-PRESSURE MERCURY VAPOR DISCHARGE LAMP

[75] Inventors: Hanns E. Fischer, Stolberg; Horst Hörster, Roetgen, both of Fed. Rep. of Germany

[73] Assignee: U.S. Philips Corporation, New York, N.Y.

[21] Appl. No.: 339,540

[22] Filed: Apr. 17, 1989

[30] Foreign Application Priority Data

Apr. 21, 1988 [DE] Fed. Rep. of Germany ..... 3813421

[51] Int. Cl.[5] ..... H01J 61/20; H01J 61/84

[52] U.S. Cl. ..... 313/571; 313/639

[58] Field of Search ..... 313/571, 639

[56] References Cited

U.S. PATENT DOCUMENTS 3,382,396 5/1968 Holmes et al. .

4,594,529 6/1986 De Vrijer ..... 313/571

FOREIGN PATENT DOCUMENTS 1109135 4/1968 United Kingdom .

1539429 1/1979 United Kingdom .

*Primary Examiner*—Palmer C. DeMeo

*Attorney, Agent, or Firm*—Brian J. Wieghaus

[57] ABSTRACT

A high-pressure mercury vapor discharge lamp whose envelope two tungsten electrodes disposed therein of tungsten and a filling containing a rare gas, a quantity of mercury larger than 0.2 mg/mm$^3$ at a mercury a pour pressure of more than 200 bar and at least one of the halogens chlorine, bromine or iodine in a quantity between $10^{-6}$ and $10^{-4}$ μmol/mm$^3$. The wall load in operation is higher than 1 W/mm$^2$.

5 Claims, 2 Drawing Sheets

HIGH-PRESSURE MERCURY VAPOR DISCHARGE LAMP

BACKGROUND OF THE INVENTION

The invention relates to a high-pressure mercury vapour discharge lamp comprising an envelope which consists of a material capable of withstanding high temperatures and comprises electrodes of tungsten and a filling substantially consisting of mercury, rare gas and a halogen, free in the operating condition, for maintaining a tungsten transport cycle.

A superhigh-pressure mercury vapor discharge lamp of this kind known from DE-AS 14 89 417 has an elongate quartz glass envelope having a volume of 55 $mm^3$. This envelope is filled with rare gas and 6.5 mg of mercury; this corresponds to a quantity of mercury of 0.12 $mg/mm^3$. The mercury vapor pressure may be about 120 bar. The lamp has a power density of about 14.5 $W/mm^3$. For lengthening the life, not only the wall of the envelope is cooled, for example by means of a flow of water, but also $5.10^{-4}$ to $5.10^{-2}$ g. atoms of at least one of the halogens per cubic millimetre are fed into the envelope.

Although such lamps at mercury vapor pressures of about 120 bar produce a high luminance, they yield essentially a typical mercury spectrum, which is superimposed on a continuous spectrum and contains a small red part.

GB PS 11 09 135 discloses a superhigh-pressure mercury vapor discharge lamp comprising a capillary tubular envelope of quartz glass, which is filled with mercury up to a quantity of 0.15 mg per $mm^3$ of volume; this corresponds to a mercury vapor pressure of about 150 bar. In order to improve the color rendition, this lamp is moreover filled with at least one metal iodide. The high electrode load of these lamps results in that tungsten evaporates from the electrodes and is deposited on the wall of the envelope. This leads to a blackening of the envelope, as a result of which the latter is strongly heated, which may give rise to an explosion of the envelope especially at high mercury vapor pressures.

SUMMARY OF THE INVENTION

The invention has for its object to provide a high-pressure mercury vapor discharge lamp of the kind mentioned in the opening paragraph, which has not only a high luminance and a satisfactory light output, but also an improved color rendition and a longer life.

According to the invention, this object is achieved in a high-pressure mercury vapor discharge lamp of the kind mentioned in the opening paragraph in that the quantity of mercury is larger than 0.2 mg per $mm^3$, the mercury vapor pressure during operation is higher than 200 bar and the wall load is higher than 1 $W/mm^2$, and in that at least one of the halogens Cl, Br and I is present in a quantity between $10^{-6}$ and $10^{-4}$ $\mu$mol per $mm^3$.

Up to a mercury vapor pressure of about 150 bar, the light output and color rendition properties of mercury high-pressure lamps are practically constant because essentially a line radiation of the mercury is emitted and an amount of continuous radiation, which originates from the recombination of electrons and mercury atoms. It was a surprise to find that at higher mercury vapor pressures the light output and the color rendition index increase considerably, which is due to a drastic increase of the amount of continuous radiation. It is presumed that at high pressures of more than 200 bar besides a continuous emission from quasi molecular states the band emission of real, bound molecule states also provides a considerable contribution. At an operating pressure of about 300 bar, the continuum part of the visible radiation lies well above 50%. As a result, the red part of the emitted light spectrum is also increased.

For achieving this high mercury vapor pressure, the envelope has a high wall temperature (about 1000° C.). Moreover, the lamp envelope is chosen as small as possible to be resistant to this high pressure. The high wall temperature and the small envelope are reflected by the high wall load of at least 1 $W/mm^2$. Efficaciously, the envelope consists of quartz glass or aluminium oxide.

The upper limit of the mercury vapour pressure depends upon the strength of the material of the envelope, but may in practical cases lie at about 400 bar. Preferably, the quantity of mercury lies between 0.2 and 0.36 mg per $mm^3$ and the mercury vapor pressure lies between 200 and 350 bar.

The very small dimensions of the envelope could lead to an increased blackening of the wall by tungsten evaporated from the electrodes. Such a blackening of the wall must absolutely be avoided, however, because otherwise the wall temperature increases during the lifetime due to increased absorption of thermal radiation, which would lead to the destruction of the lamp envelope. As a measure to avoid such a wall blackening by tungsten transport, the high-pressure mercury vapor discharge lamp according to the invention contains a small quantity of at least one of the halogens chlorine, bromine or iodine. These halogens create a tungsten transport cycle, by which the tungsten evaporated is transported back to the electrodes.

Efficaciously, in the high-pressure discharge lamp according to the invention, the halogen used is bromine, which is introduced into the lamp in the form of $CH_2Br_2$ at a filling pressure of about 0.1 mbar. This compound decomposes as soon as the lamp is lit.

The mercury vapor discharge lamp according to the invention does not contain a metal halide because such a high metal halide concentration would be required for a substantial increase of the continuum part of the radiation that a very rapid corrosion of the electrodes would occur due to the high tungsten transport rates. Heavily loaded metal halide lamps, as described, for example, in GB-PS 1109135, therefore typically reach only lifetimes of a few hundred hours, whereas in the lamps according to the invention lifetimes of more than 5000 hours could be reached with a substantially constant light output ($\Delta\eta<2\%$) and substantially unchanged color coordinates ($\Delta x$, $\Delta y$ $<0.005$ during 5000 hours).

The lamp according to the invention has a color temperature of more than 8000 K. The color temperature and the colour rendition can be further improved in a discharge lamp according to the invention in that the lamp is surrounded by a filter to block blue radiation.

In this connection, it should be pointed out that it is known from GB-PS 15 39 429 to reduce the blue part of the radiation in high-pressure mercury vapor discharge lamps with halide addition by the use of a filter and hence to attain a color improvement of the emitted radiation. In mercury vapor discharge lamps at a mercury vapor pressure up to about 150 bar, such a filter would practically be ineffective because the emitted light substantially does not contain a red part. The spectrum of the lamp according to the invention, however, contains such a large part of continuous red radiation that by means of a filter for the blue radiation part, with a loss of light of only 15%, the emission of white light having a color temperature of about 5500 K. and a color rendition index of about 70 can be attained.

BRIEF DISCRIPTION OF THE DRAWINGS

A few embodiments according to the invention will now be described with reference to the drawing. In the drawing.

Description of the Preferred Embodiments

Figure 1:
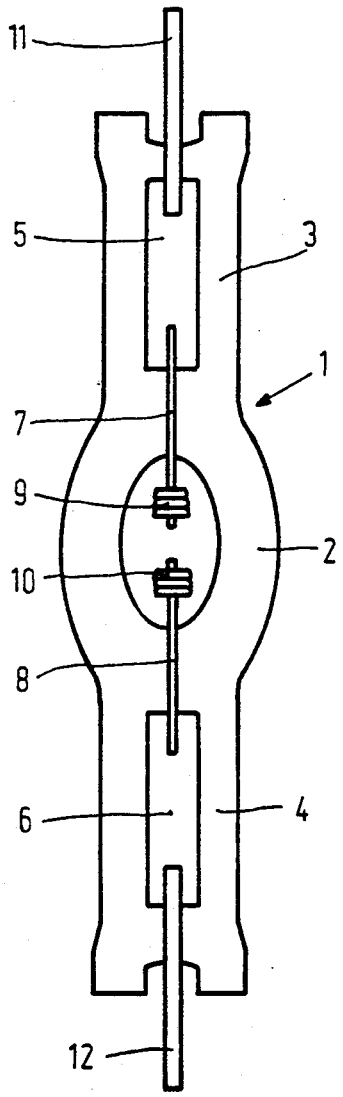
FIG. 1 shows a high-pressure mercury vapor discharge lamp having an elliptical lamp envelope.

The high-pressure mercury vapor discharge lamp 1 shown in FIG. 1 has an elliptical lamp envelope 2 of quartz glass. The envelope ends are adjoined by cylindrical quartz parts 3 and 4, into which molybdenum foils 5 and 6 are sealed in a vacuum-tight manner. The inner ends of the molybdenum foils 5 and 6 are connected to electrode pins 7 and 8 of tungsten, which carry wrappings or coils 9 and 10 of tungsten. The outer ends of the molybdenum foils 5 and 6 are adjoined by current supply wires 11 and 12 of molybdenum extending to the exterior.

Figure 2:
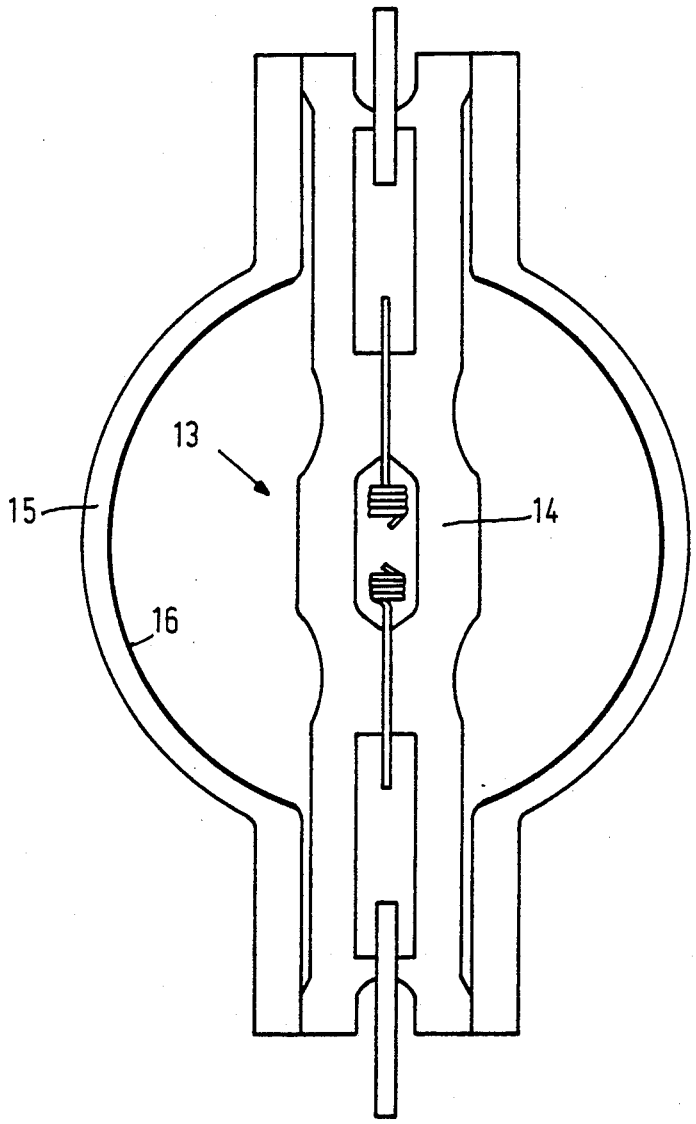
FIG. 2 shows a high-pressure mercury vapor discharge lamp having a cylindrical lamp envelope, which is surrounded by an outer envelope coated with a filter.

The high-pressure mercury vapor discharge lamp 13 shown in FIG. 2 is constructed in a similar manner as the lamp shown in FIG. 1. The lamp envelope 14 is however, of cylindrical shape. The lamp 13 is surrounded by an outer envelope 15 of quartz glass, which is coated on the inner side with an interference filter 16. This filter 16 serves to reduce the blue radiation emitted by the lamp 13.

The data of a few practical embodiments now follow:

LAMP 1

Elliptical lamp envelope of FIG. 1 having a wall thickness of 1.8 mm; the inner dimensions and operating data are:

| | |
|---|---|
| length | 7 mm |
| diameter | 2.5 mm |
| envelope volume | 23 $mm^3$ |
| electrode gap | 1.2 mm |
| filling mercury | 6 mg Hg (0.261 $mg/mm^3$) |
| halogen | $5 \cdot 10^{-6}$ μmol of $CH_2Br_2$ ($10^{-5}$ μmol of $Br/mm^3$) |
| operating pressure | about 200 bar |
| power | 50 W |
| operating voltage | 76 V |
| light output | 58 lm/W |
| wall load | 1.30 $W/mm^2$. |

LAMP 2

Elliptical lamp envelope of FIG. 1 having a wall thickness of 1.7 mm; the inner dimensions and operating data are:

| | |
|---|---|
| length | 5 mm |
| diameter | 2.5 mm |

-continued

| | |
|---|---|
| envelope volume | 16.5 $mm^3$ |
| electrode gap | 1.0 mm |
| filling mercury | 4 mg of Hg (0.243 $mg/mm^3$) |
| halogen | $5 \cdot 10^{-6}$ μmol/$mm^3$ of $CH_2Br_2$ |
| operating pressure | about 220 bar |
| power | 40 W |
| operating voltage | 80 V |
| light output | 56 lm/W |
| wall load | 1.30 $W/mm^2$. |

LAMP 3

Cylindrical lamp envelope of FIG. 2 having a wall thickness of 1.3 mm, without an outer envelope. The inner dimensions and operating data are:

| | |
|---|---|
| length | 4 mm |
| diameter | 1.5 mm |
| envelope volume | 7 $mm^3$ |
| electrode gap | 1.0 mm |
| filling mercury | 2.5 mg of Hg (0.357 $mg/mm^3$) |
| halogen | $5 \cdot 10^{-6}$ μmol/$mm^3$ of $CH_2Br_2$ |
| operating pressure | 300 bar |
| power | 30 W |
| operating voltage | 92 V |
| light output | 60 lm/W |
| wall load | 1.36 $W/mm^2$ . |

The lamps described have a color temperature of more than 8000 K.; however, the color rendition is considerably improved in comparison with lamps having a low operating pressure. For example, the color rendition index $R_a$ is for the three lamps just described 51.5, 55.2 and 61.6, whereas with similar lamps at an operating pressure of 100 bar only a colour rendition index of 32.7 was attained.

Figure 3:
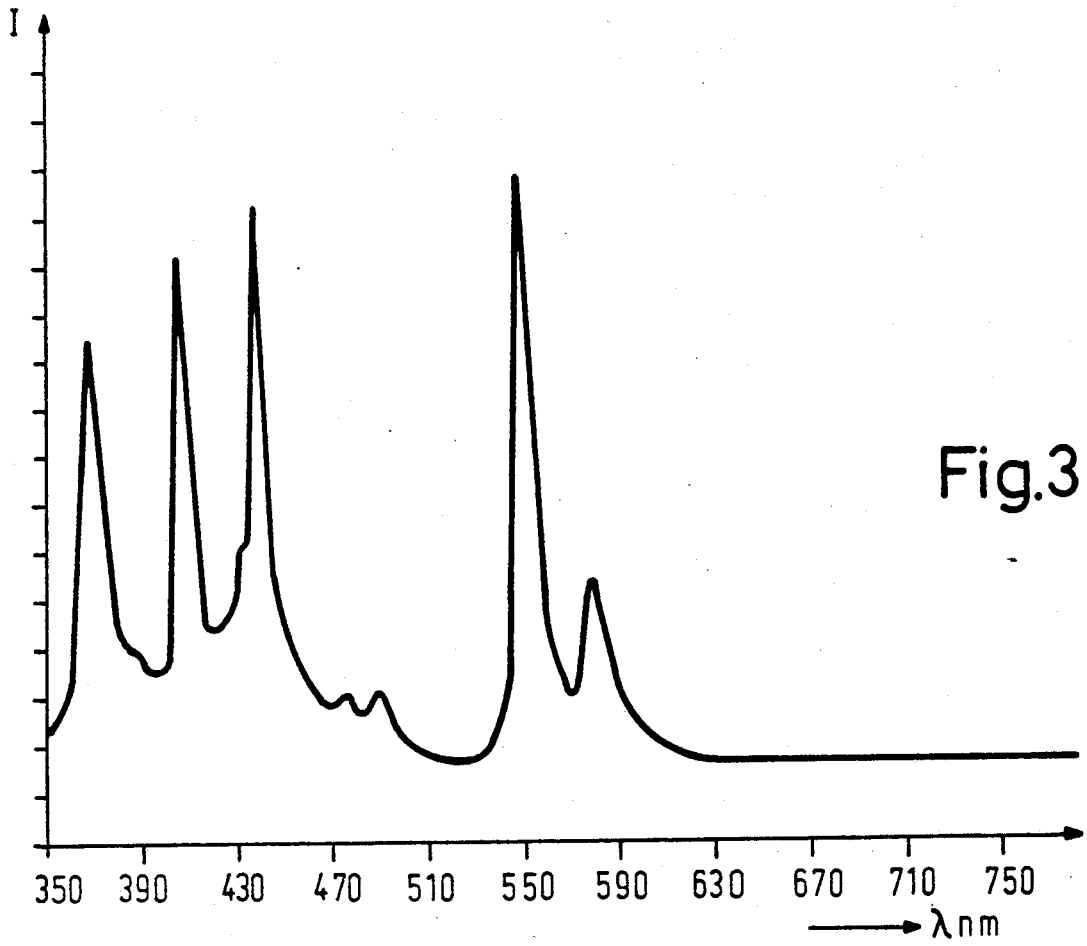
FIG. 3 shows the emitted light spectrum of a high-pressure mercury vapor discharge lamp at a mercury vapor pressure of more than 200 bar.

In FIG. 3, the light spectrum emitted by a lamp according to Example 2 is plotted as intensity I against the wavelength. It appears therefrom that the continuum part of the visible radiation lies at about 50%.

Figure 4:
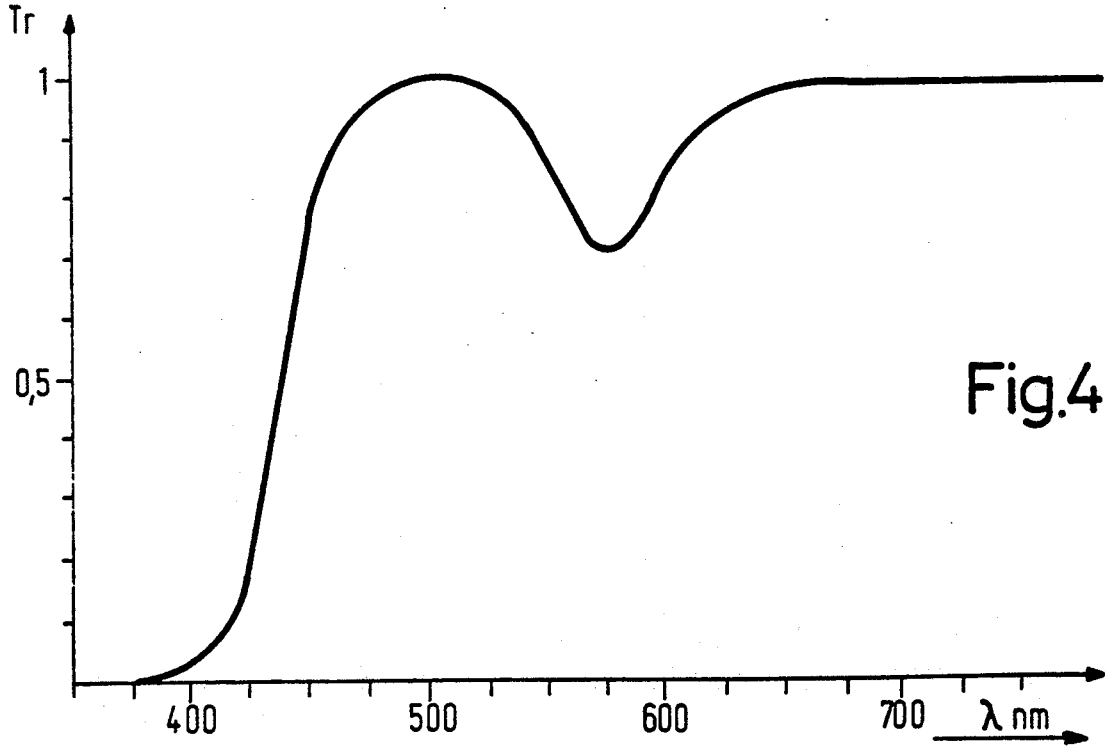
FIG. 4 shows the transmission spectrum of a filter used in the lamp shown in FIG. 2.

In the lamp shown in FIG. 2, the interference filter 16 consists, for example, of an alternating sequence of layers of titanium dioxide modified with $ZrO_2$ and amorphous silicon dioxide. In a practical embodiment, the filter used had a degree of transmission Tr as represented in FIG. 4 as a function of the wavelength λ. The following light-technical data were then found:

| | | |
|---|---|---|
| Without a filter: | color temperature: | 8580K |
| | color rendition index: | 55.2 |
| | light output: | 56 lm/W |
| With a filter: | color temperature: | 5500K |
| | color rendition index: | 69.7 |
| | light output: | 48 lm/W. |

It appears therefrom that by the interference filter not only the colour temperature is strongly reduced, but also the color rendition index has considerably improved.

With respect to comparable heavily loaded metal halide lamps, the lamps according to the invention have an extremely high constancy of the light-technical data, a substantially unchanged light output during the operating time, and a very long life. While lifetimes of a few hundred hours are attained with heavily loaded metal halide lamps, the lamps according to the invention substantially do not exhibit any changes even after an operating time of more than 5000 hours.

We claim:

1. A high-pressure mercury vapor discharge lamp comprising a discharge envelope, a pair of discharge electrodes comprising tungsten between which a discharge is maintained during lamp operation, and a filling essentially consisting of mercury, a rare gas, and a halogen for maintaining a tungsten transport cycle during lamp operation, characterized in that: the quantity of mercury is larger than 0.2 $mg/mm^3$, during lamp operation the mercury vapor pressure is higher than 200 bar and the wall load is higher than 1 $W/mm^2$, and in that at least one of the halogens Cl, Br or I is present in a quantity between $10^{-6}$ and $10^{-4}$ $\mu mol/mm^3$.

2. A discharge lamp as claimed in claim 1, characterized in that the quantity of mercury lies between 0.2 and 0.35 $mg/mm^3$ and the mercury vapor pressure during lamp operation lies between 200 and 350 bar.

3. A discharge lamp as claimed in claim 2 characterized in that it is surrounded by a filter blocking blue radiation.

4. A discharge lamp as claimed in claim 1, characterized in that it is surrounded by a filter blocking blue radiation.

5. A discharge lamp as claimed in claim 1, characterized in that the mercury vapor pressure is about 400 bar.

* * * * *

US005109181C1

(12) EX PARTE REEXAMINATION CERTIFICATE (7410th)

United States Patent

Fischer et al.

(10) Number: US 5,109,181 C1

(45) Certificate Issued: Mar. 23, 2010

(54) HIGH-PRESSURE MERCURY VAPOR DISCHARGE LAMP

(75) Inventors: Hanns E. Fischer, Stolberg (DE); Horst Hörster, Roetgen (DE)

(73) Assignee: U.S. Philips Corporation, New York, NY (US)

Reexamination Request:
No. 90/009,367, Dec. 18, 2008

Reexamination Certificate for:

| | |
|---|---|
| Patent No.: | **5,109,181** |
| Issued: | **Apr. 28, 1992** |
| Appl. No.: | **07/339,540** |
| Filed: | **Apr. 17, 1989** |

(30) Foreign Application Priority Data

Apr. 19, 1988 (DE) ..... 3813421

(51) Int. Cl.

| | |
|---|---|
| ***H01J 61/12*** | (2006.01) |
| ***H01J 61/00*** | (2006.01) |
| ***H01J 61/82*** | (2006.01) |

(52) U.S. Cl. ..... 313/571; 313/112; 313/639

(58) Field of Classification Search ..... None
See application file for complete search history.

(56) References Cited

U.S. PATENT DOCUMENTS

| | | | | |
|---|---|---|---|---|
| 1,025,932 A | | 5/1912 | Steinmetz | |
| 2,094,694 A | | 10/1937 | Bol et al. | |
| 2,295,046 A | | 9/1942 | Noel | |
| 2,697,183 A | | 12/1954 | Neunhoeffer | |
| 2,883,571 A | | 4/1959 | Fridrich | |
| 3,160,454 A | | 12/1964 | Zubler et al. | |
| 3,234,421 A | | 2/1966 | Reiling | |
| 3,259,777 A | | 7/1966 | Fridrich | |
| 3,382,396 A | * | 5/1968 | Holmes et al. | 313/620 |
| 3,541,378 A | | 11/1970 | Pebler | |
| 3,712,701 A | | 1/1973 | Johnston | |
| 3,714,493 A | | 1/1973 | Fridrich | |
| 3,974,370 A | | 8/1976 | Pearson | |
| 4,020,377 A | | 4/1977 | Popp | |
| 4,389,201 A | | 6/1983 | Hansler | |
| 4,594,529 A | | 6/1986 | De Vrijer | |
| 4,686,419 A | | 8/1987 | Block | |

FOREIGN PATENT DOCUMENTS

| | | |
|---|---|---|
| EP | 0004082 | 3/1979 |
| EP | 0793257 | 10/1998 |
| JP | 495421 | 5/1969 |
| JP | 54-150871 | 5/1978 |

OTHER PUBLICATIONS

Bernhardt, "Sattigungsdrucke Von HG BIS 2000 KG/CM2", Physickalishe Zeitschrift, vol. 6, p. 265, Mar. 15, 1925.

Elenbaas, "The High Pressure Mercury Vapour Dishcarge", 1951, Netherlands.

Elenbaas, "Light Sources", 1972, pp. 125, 155–158, Netherlands.

Nesmeyanov, "Vapor Pressure of the Elements", p. 218, (J.J. Carasso, Translator), Infosearch 1963.

Stormberg et al, "Time Dependent Behavior of High Pressure Mercury Discharges", J Appl. Phys. 54(8) 4338, Aug. 1983.

Waymouth, "Electric Discharge Lamps", 1971, Chpater 8.

High Pressure Mercury Vapour Lamps and Their Applications, Elenbaas et al., 1965, Netherlands.

W. Elenbaas, High Pressure Mercury Vapour Lamps And Their Applications, 1965, pp. 240, 267, 283, 292, 298, Netherlands.

John F. Waymouth, "Electric Discharge Lamps," 1971, p. 152, USA.

(Continued)

*Primary Examiner*—Lynne H Browne

(57) ABSTRACT

A high-pressure mercury vapor discharge lamp whose envelope two tungsten electrodes disposed therein of tungsten and a filling containing a rare gas, a quantity of mercury larger than 0.2 mg/mm$^3$ at a mercury a pour pressure of more than 200 bar and at least one of the halogens chlorine, bromine or iodine in a quantity between $10^{-6}$ and $10^{-4}$ μmol/mm$^3$. The wall load in operation is higher than 1 W/mm$^2$.

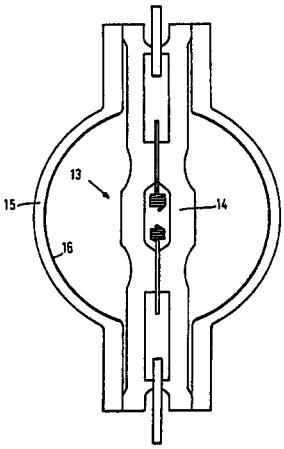

OTHER PUBLICATIONS

John F. Waymouth, "Light Source Technology 1979—A Review," 2nd International Symposium on the Science & Technology of Light Sources (LS:2), 1979, Netherlands.
H.K. Bourne, "Discharge Lamps For Photography And Projection," 1948, pp. 76, 167–168, 174, 188, England.
Frank P. Incropera, et al., Fundamentals of Heat and Mass Transfer, 2007 p. 4, USA.
T. Geszti & T Vicsek, "A Thermaldynamical Study of Halogen Lamps With Carbon Additive," 9 J. Phys. D: Appl. Phys. 903–912 (1976), England.
Guenther Derra et al., "UHP Lamp Systems for Projection Applications," 38 J. Phys. D: Appl. Phys. 2995–3010 (2005), Germany.
Heraeus, "Heraeus Quarzglas—Thermal properties," http://www.heraeus–quarzglas.de (last visited Nov. 28, 2009), Germany.
Holger Moench & Arnd Ritz, "Higher–Output More–Compact UHP Lamp Systems," 1 J. of the SID 1–9 (2003), USA.
T Hiramoto, "Compact HID Lamps for Liquid Crystal Projectors," 6th International Symposium on the Science & Technology of Light Sources (LS:6), Invited Paper 67:I, 1992, Hungary.
M Narita, "A New Metal Halide Lamp for Color LCD Projectors," 5th International Symposium on the Science & Technology of Light Sources (LS:5), Invited Paper 97:P, 1989, England.
K. Tomokiyo & Y. Kitahara, "Effects of Cold Spot Temperature and Operation Frequency on the Spectral Properties of Metal Halide Lamps for LCD Projectors," 6th International Symposium on the Science & Technology of Light Sources (LS:6), Invited Paper 73:P, 1992, Hungary.
N. Takeuchi, et al., Short Arc Metal Halide Lamp with New Ingredients fro LCD Projector, 7th International Symposium on the Science & Technology of Light Sources (LS:7), Invited Paper 28:L, 1995, Japan.
T. Higashi, "Life Performance Improvement of the Short Arc Metal Halide Lamp by DC Operation," 7th International Symposium on the Science 7 Technology of Light Sources (LS:6), Invited Paper 32:P, 1995, Japan.
H. Moench & G. Derra, "Light Sources for Video Projection," 8th International Symposium on the Science & Technology of Light Sources (LS:8), Invited Paper C:13, 1998, Germany.
The Society for Information Display, Press Release, "14 Distinguished Papers Selected as Best of the Best for Next Month's SID 2006 International Symposium," (May 23, 2006), USA.
The Society for Information Display, "40 Years of SID Symposia—Nurturing Progress in Projection Technology," 2001, USA.
Holger Moench et al., UHP Lamps for Projection, 10 Journal of the SID 87, 87 (2002), USA.
Guenther Derra et al., "New UHP Lamp Technologies for Video Projection," 9th International Symposium on the Science & Technology of Light Sources (LS:9), Invited Paper 1:I, 2001, USA.
J.R. Coaton, "Operating Pressure of Incandescent and Tungsten–Halogen Lamps and Influence of Envelope Temperature on Life," 9 Lighting Research & Tech. 25–30 (1977), England.
Japan Patent Office Decision 2003–35241, Mar. 14, 2004, with translation.
Japan Intellectual High Court Case No. (Gyo–ke) 10314, Mar. 20, 2006, with translation.
Japan Supreme Court, Denial of Appeal, Oct. 19, 2006, with translation.
Fischer, Ultra–high performance discharge lamps for projection TV systems, (8th International Symposium on the Science & Technology of Light Sources (LS–8), Invited Lecture 5, 1998).

* cited by examiner

EX PARTE REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1–5 is confirmed.

* * * * *